US009174773B2

(12) United States Patent
Schleucher et al.

(10) Patent No.: US 9,174,773 B2
(45) Date of Patent: Nov. 3, 2015

(54) CLOSURE CLIP HAVING A PLURALITY OF SPIKES

(71) Applicant: Poly-clip System GmbH & Co. KG, Hattersheim (DE)

(72) Inventors: Heiko Schleucher, Gedern (DE); Uwe Melchert, Frankfurt (DE)

(73) Assignee: Poly-clip System GmbH & Co. KG, Hattersheim (DE)

( * ) Notice: Subject to any disclaimer, the term of this patent is extended or adjusted under 35 U.S.C. 154(b) by 350 days.

(21) Appl. No.: 13/631,766

(22) Filed: Sep. 28, 2012

(65) Prior Publication Data

US 2013/0081235 A1 Apr. 4, 2013

(30) Foreign Application Priority Data

Sep. 30, 2011 (DE) ..... 20 2011 106 293 U

(51) Int. Cl.
*A41F 1/00* (2006.01)
*B65D 33/16* (2006.01)

(52) U.S. Cl.
CPC ..... *B65D 33/1641* (2013.01); *Y10T 24/44991* (2015.01)

(58) Field of Classification Search
CPC .. F16B 15/0015; F16B 15/00; F16B 15/0046; F16B 12/00; F16B 15/02; E04B 1/49; B65D 33/1641; B65D 33/1625; A22C 11/125; B65B 51/04; B27M 3/34; F16G 11/00
USPC ..... 24/570, 571, 30.5 W, 20 CW, 20 W; 411/457, 475
See application file for complete search history.

(56) References Cited

U.S. PATENT DOCUMENTS

| | | | | |
|---|---|---|---|---|
| 403,567 | A * | 5/1889 | Wales | 24/11 CT |
| 1,230,246 | A * | 6/1917 | Wegwart | 411/457 |
| D51,186 | S * | 8/1917 | Pearson | D32/61 |

(Continued)

FOREIGN PATENT DOCUMENTS

| | | |
|---|---|---|
| CN | 1505584 A | 6/2004 |
| CN | 201037490 Y | 3/2008 |

(Continued)

OTHER PUBLICATIONS

DE19700692A1—Machine Translation obtained from Espacenet (http://worldwide.espacenet.com) on May 17, 2013, 8 pages.

*Primary Examiner* — Robert J Sandy
*Assistant Examiner* — Matthew Sullivan
(74) *Attorney, Agent, or Firm* — Fitch, Even, Tabin & Flannery LLP

(57) ABSTRACT

A closure clip is provided for closing tubular or bag-shaped packaging for bulk produce such as fruit or vegetables. The closure clip includes a first arm and a second arm extending substantially in a plane and aligned at least approximately parallel to each other, with the arms each having first and second ends and a base portion extending in the center plane defined by the arms and having an inner and an outer surface, with the base portion connecting the first and second arms at their first ends and forming an approximately U-shaped closure clip. The closure clip further includes a first spike having a first end and a second end, extending from the inner surface of the base portion between the arms and parallel thereto, and connected with its first end to the base portion. The closure clip further has at least one second spike having first and second ends.

10 Claims, 1 Drawing Sheet

(56) References Cited

U.S. PATENT DOCUMENTS

| | | | | | |
|---|---|---|---|---|---|
| 1,654,371 | A | | 12/1927 | Goodstein | |
| 2,748,645 | A | | 6/1956 | Peckham et al. | |
| 2,782,673 | A | * | 2/1957 | Packard | 411/461 |
| 3,584,347 | A | | 6/1971 | Klenz | |
| 4,131,975 | A | | 1/1979 | Niedecker | |
| 4,454,875 | A | * | 6/1984 | Pratt et al. | 606/75 |
| 4,960,420 | A | * | 10/1990 | Goble et al. | 606/232 |
| 5,314,065 | A | * | 5/1994 | Ayres et al. | 206/340 |
| 5,715,987 | A | | 2/1998 | Kelley et al. | |
| 5,809,723 | A | * | 9/1998 | Keith et al. | 52/405.1 |
| 5,852,850 | A | | 12/1998 | Hanten et al. | |
| 6,173,836 | B1 | | 1/2001 | Cooper | |
| 6,293,399 | B1 | | 9/2001 | Cooper | |
| 6,401,306 | B1 | | 6/2002 | Hanten et al. | |
| 6,446,801 | B2 | | 9/2002 | Cooper | |
| 6,957,756 | B2 | | 10/2005 | Lat et al. | |
| 7,565,780 | B2 | | 7/2009 | Pinto et al. | |
| 7,666,073 | B2 | | 2/2010 | Schleucher et al. | |
| 8,602,286 | B2 | | 12/2013 | Crainich et al. | |
| 2002/0017473 | A1 | | 2/2002 | Cooper | |
| 2007/0289252 | A1 | | 12/2007 | Pinto et al. | |
| 2011/0038689 | A1 | * | 2/2011 | MacDonald et al. | 411/475 |
| 2011/0078970 | A1 | * | 4/2011 | Boyd | 52/506.07 |

FOREIGN PATENT DOCUMENTS

| | | | |
|---|---|---|---|
| DE | 19505359 | A1 | 9/1996 |
| DE | 19527875 | A1 | 1/1997 |
| DE | 19700692 | A1 | 7/1998 |
| EP | 0757003 | A1 | 2/1997 |
| EP | 0809592 | A1 | 12/1997 |
| EP | 1970321 | A1 | 9/2008 |
| JP | 2003026198 | A | 1/2003 |
| WO | 8602618 | A1 | 5/1986 |
| WO | 9625340 | A1 | 8/1996 |

* cited by examiner

CLOSURE CLIP HAVING A PLURALITY OF SPIKES

This application claims priority to, and the benefit of, German Patent Application No. 20 2011 106 293.0 filed Sep. 30, 2011 with the German Patent Office, which is hereby incorporated by reference.

BACKGROUND OF THE INVENTION

The present invention relates to a closure clip according to the preamble of independent claim 1. More specifically, the present application relates to a closure clip for closing a tubular or bag-shaped packaging for bulk produce to be packaged, such as fruit or vegetables, said closure clip having two first and second arms extending substantially in a plane and aligned at least approximately parallel to each other, said arms having first and second ends and a base portion extending in the plane defined by the arms and having an inner and an outer surface, said base portion connecting the first and second arms at their first ends and forming an approximately U-shaped closure clip.

Bulk produce to be packaged, such as fruit or vegetables, for example, is usually packaged in tubular or bag-shaped packaging for storage or for transport. Such tubular or bag-shaped packaging may consist of a netting material, for example, and may be closed at one end, for example by a closure clip.

Clipping machines, by means of which the closure clips are applied to the tubular or bag-shaped packaging to be closed, are used to package the aforementioned goods in the tubular or bag-shaped packaging.

Known clipping machines for closing such packaging and for applying closure clips and suspension elements, such as loops, also include displacer elements for constricting the filled tubular or bag-shaped packaging and for providing a plait-like portion onto which the closure clip is placed and closed. After the plait-like portion has been formed by the displacer elements, a closure clip is conveyed to the plait-like portion and positioned thereon in such a way that the at least approximately U-shaped closure clip grips around the plait-like portion of the tubular or bag-shaped packaging. The closure clip is then closed by appropriate closing tools, such as a punch and a die. The die supports the bottom portion of the clip, thus holding it in position, while the punch moves towards the free ends of the clip arms, causing the latter to be bent around the plait-like portion.

A closure clip for bags and tubes is known from the laid-open German patent specification DE 197 00 692. The substantially U-shaped closure clip has a bottom clip portion and arms which are joined to said bottom portion. To close a bag or tube, the closure clip is moved by means of a punch onto the plait formed out of the packaging material, as a result of which the closure clip grips around the plait. The free ends of each of the arms are bent around the plait by means of a die which has slide channels. In the closed state, the arms of the closure clip lie at least approximately parallel to each other, so the closure clip forms a closed ring around the plait of packaging material.

Loose goods or foods, such as fruit or vegetables, are often packed into bags of netting material, which is made of plastic, for example. If such tubular or bag-shaped packaging consisting of plastic netting is closed by a closure clip, which itself is made of plastic in many cases, the closure clip may slip off the plait-like portion of the tubular or bag-shaped packaging material due to the frictional forces between the bag material and the clip being so weak. Even when the closure clip has a profile on its inner side, for example in the form of serrations which dig into the packaging material, there is a risk of the clip slipping off the plait-like portion of the packaging material if the packaged goods are heavy of if additional forces act on the clip, for example when carrying the bag. The packaging material is also at risk of being damaged when the clips are made of metal, which it may be possible to close more firmly than clips made of plastic.

The object of the present invention is therefore to provide a closure clip which overcomes the aforementioned disadvantages and which makes the closure of tubular or bag-shaped packaging more reliable and secure.

The aforesaid object is achieved in respect by a closure clip having the features of independent claim 1. Other advantageous developments of the closure clip according to the invention are described in the claims 2 to 10.

BRIEF SUMMARY OF THE INVENTION

According to the present invention, a closure clip for closing tubular or bag-shaped packaging for bulk produce such as fruit or vegetables is proposed. The closure clip comprises two first and second arms extending substantially in a plane and aligned at least approximately parallel to each other, said arms having first and second ends, and a base portion extending in the centre plane defined by the arms and having an inner and an outer surface, said base portion connecting the first and second arms at their first ends and forming an approximately U-shaped closure clip. In one preferred embodiment of the closure clip, a first spike having a first end and a second end extends from the inner surface of the base portion between the arms and parallel thereto and is connected with its first end to the base portion. The length of the first spike is at least equal to a dimension of the cross-section of at least one of the arms. The closure clip according to the invention further comprises at least one second spike having a first and second ends, which extends from the inner surface of the base portion between one of the arms and the first spike and parallel thereto. The second spike is connected with its first end to the base portion, the length of the second spike being shorter than the length of the first spike.

According to the invention, a third spike having first and second ends is likewise provided, which extends from the inner surface of the base portion between the other one of the arms and the first spike and parallel thereto. The third spike is connected by its first end to the base portion, the length of the third spike being shorter than the length of the first spike.

When the closure clip is closed, the first, second and/or third spikes dig into the packaging material, thus reliably preventing the closure clip from slipping off the packaging material. Due to the first spike having the length specified in the claim, it extends completely through the packaging material gathered into a plait, thus reliably preventing the closure clip from slipping off. The second and third spikes dig additionally into further plait material, thus increasing the reliability of the clip even further.

In order to achieve a further increase in this securing effect of the first spike at least, the length of the first spike is a multiple of a dimension of the cross-section of at least one of the arms.

According to the invention, the first spike has such a length that it extends with its second end into a gap between the arms when the closure clip is in its closed configuration, in which it is bent around the tubular or bag-shaped packaging to be closed and in which the arms lie approximately parallel to each other at least in sections, wherein the second end of the first arm faces towards the first end of the second arm and the second end of the second arm faces towards the first end of the first arm. In this configuration, the second end of the first spike is supported by the two arms of the closure clip. This prevents the first spike from being bent in a direction perpendicular to the plane defined by the clip, so that the clip cannot slip off the packaging material. The invention is also characterized in that the cross-section of the first spike tapers in the direction of its second end, as a result of which the first spike can dig into the packaging material more easily. The first spike may have a conical shape or even a pyramidal shape.

If only a first and a second spike are provided, these may also be arranged in the plane defined by the clip, wherein the first and the second spike may then be distributed symmetrically between the arms of the clip. In that case, the first and second spike may have the same length.

In one preferred embodiment of the closure clip according to the invention, the second and third spikes are arranged at a distance from and parallel to the plane defined by the arms. In this arrangement, the first, the second and the third spikes are offset from each other, thus preventing any impermissible damage when the first, second and third spikes dig into or pierce through the packaging material, and thus increasing the reliability of the closure even further. The second and third spikes may be arranged on different sides of the plane defined by the arms. However, the second and third spikes may also be arranged on the same side of the middle plane defined by the arms of the closure clip. However, it is essential in that case to avoid the first, the second and the third spikes being arranged in the same plane, in order to prevent any damage being caused to the packaging material by the first, second and third spikes being arranged too close to each other.

The invention is further characterized by the cross-section of the second spike and of the third spike tapering in the direction of the second end, as a result of which the second spike and the third spike can dig into the packaging material more easily. The second and third spikes may have a conical or a pyramidal shape.

To make it even easier for the first, second and third spikes to dig into the packaging material, the first spike and/or the second and third spikes may also end in a sharp point at their second ends, according to the invention. If the intention is that the second and third spikes merely allow greater engagement with or hooking into the packaging material, with no intention of perforating the packaging material, a sharp point at the ends of the second and third spikes is not necessary.

According to another preferred embodiment of the closure clip according to the invention, a cam is arranged on the outer surface of the base portion. This cam may serve to align the inventive closure clip when it is being closed. For that case, the punch should be provided with a recess which corresponds to the cam and with which the cam engages while the clip is being moved by the punch towards the die. By correctly aligning the closure clip during the closure operation, the quality of the closure is further enhanced.

Other advantages and a preferred embodiment of the invention shall now be described with reference to the following drawings. The expressions "left", "right", "top", and/or "bottom" that are used in this connection relate to the drawings in their normal orientation, according to the orientation of the drawing numbers and the reference signs.

DETAILED DESCRIPTION OF THE INVENTION

Figure 1:
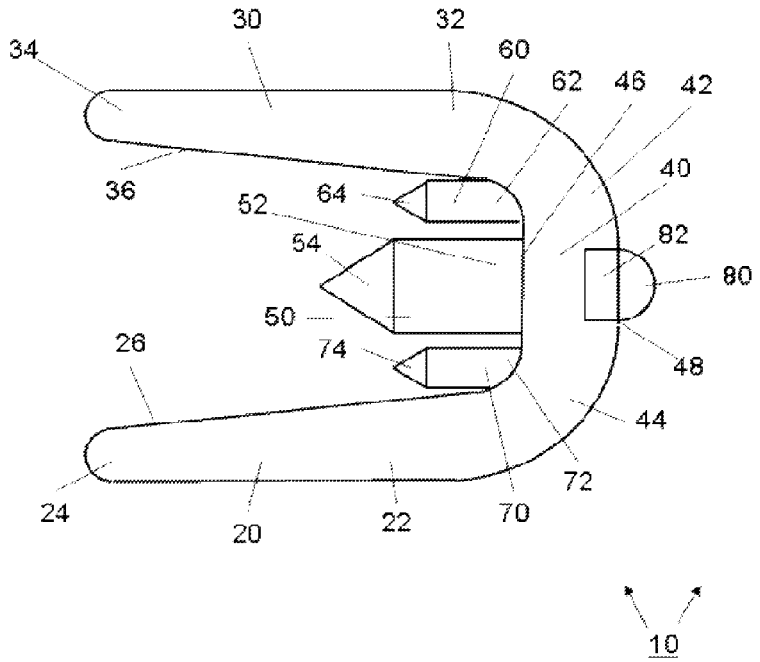
FIG. 1: shows a side view of a closure clip according to the invention.

FIG. 1 is a side view of a preferred embodiment of the closure clip according to the present invention. As can be seen from FIG. 1, closure clip 10 is at least approximately U-shaped. Closure clip 10 has two arms 20, 30, which are connected to a base portion 40.

Arms 20, 30 have first ends 22, 32, which are connected to base portion 40 via arc-shaped portions 42, 44. Arms 20, 30 also have second, free ends 24, 34. Arms 20, 30 are oriented parallel to each other and define a plane or centre plane E (cf. FIG. 2). Base portion 40 is oriented in centre plane E and substantially at right angles to arms 20, 30. Arms 20, 30 have inner surfaces 26, 36 which face towards the inner side of closure clip 10 and outer surfaces 28, 38 which face away from closure clip 10. Base portion 40 has an inner surface 46 which faces towards the inner side of closure clip 10 and an outer surface 48 which faces away from closure clip 10. The arc-shaped portions 42, 44 have inner radii Ri and outer radii Ra.

As can also be seen from FIG. 1, closure clip 10 has a first spike 50 which is disposed on the inner surface 46 of base portion 40. The first spike 50 has a first end 52 which is connected to the inner surface 46 of base portion 40, and a second end 54 which faces away from base portion 40. The first spike 50 extends in a plane E defined by arms 20, 30 and substantially parallel to arms 20, 30. As can likewise be seen from FIG. 1, the cross-section of the first spike 50 tapers at least in the region of its second end 54. The second end 54 of the first spike 50 ends in a sharp point.

As can further be seen from FIG. 1, closure clip 10 has a second spike 60 and a third spike 70. The second spike 60 and the third spike 70 have first ends 62, 72 and second ends 64, 74. The second spike 60 is arranged with its first end 62 on arc-shaped portion 42 and extends between the first spike 50 and the second arm 30, as well as parallel thereto and parallel to centre plane E. The third spike 70 is arranged with its first end 72 on arc-shaped portion 44 and extends between the first spike 50 and the first arm 20, as well as parallel thereto and parallel to plane E. As can be seen from FIG. 1, the second spike 60 and the third spike 70 are at least of approximately the same length, the first spike 50 being longer than the second and the third spikes 60, 70. The cross-section of the second and third spikes 60, 70 tapers at least in the region of their second ends 64, 74. Like the first spike 50 also, the second ends 64, 74 of the second and third spikes 60, 70 end in a sharp point. The cross-section of the first, second and third spikes 50, 60, 70 is at least approximately constant over one portion, at least in the region of their first ends 52, 62, 72.

As can also be seen from FIG. 1, a cam 80 is arranged on the outer surface 48 of base portion 40 of closure clip 10. Cam 80 is arranged at least approximately on the side of base portion 40 which is opposite the first spike 50. Cam 80 is approximately semi-circular in shape. Closure clip 10 also has a projection 82, which extends over cam 80 and over an approximately rectangular portion of base portion 40. This projection 82 laterally protruding from closure clip 10 is used to join the closure clip to other closure clips on the sides opposite projection 82, in order to thus form a line of clips in which closure clips 10 are aligned in such a way that their centre planes E are aligned parallel to each other, where a line of clips thus formed can be stored as a line of clips or wound onto a roll of clips, for example.

Figure 2:
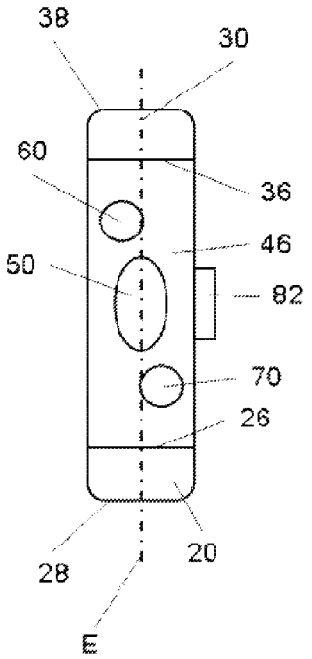
FIG. 2: shows a plan view from the left onto the closure clip of FIG. 1.

FIG. 2 shows a view of the inventive closure clip 10 in FIG. 1, as viewed from the left-hand side. As can be seen from FIG. 2, the first, second and third spikes 50, 60, 70 are arranged on the inner surface 46 of base portion 40. As can also be seen from FIG. 2, the second and third spikes 60, 70 have an approximately circular cross-section, whereas the first spike 50 has an oval cross-section. Spike 50 is aligned in such a way that the longer axis of the oval cross-section lies in plane E, whereas the shorter axis of the oval cross-section is oriented perpendicular to plane E. As can also be seen from FIG. 2, projection 82 protrudes beyond clip 10 to the right-hand side in FIG. 2.

Arms 20, 30, as can likewise be seen from FIG. 2, have an at least approximately rectangular cross-section, the respective outwardly facing corners of arms 20, 30 being rounded. The inner surfaces 26, 36 and the outer surfaces 28, 38 of arms 20, 30 are oriented at least approximately parallel to each other.

As described in the foregoing, arms 20, 30 of closure clip 10 are oriented at least approximately parallel to each other. However, it is also possible that arms 20, 30 are oriented divergently from each other, the distance between the second ends 24, 34 preferably being larger than the distance between the first ends 22, 32.

Arms 20, 30, and base portion 40, may also have a cross-section different from that shown in FIG. 2, of course, for example a round or a triangular cross-section.

The round cross-section of the second and third spikes 60, 70, and the oval cross-section of the first spike 50, shown in FIG. 2, are not imperative, either. The first, second and third spikes 50, 60, 70 may, of course, have a cross-section which deviates there from, for example a triangular or rectangular cross-section. In like manner, the cross-section of spike 50 may be approximately circular, with the cross-sections of the second and third spikes 60, 70 being oval, in contrast.

What is claimed is:

1. A closure clip for closing tubular or bag-shaped packaging for bulk produce such as fruit or vegetables, comprising:

two arms forming a first and second arm extending substantially in a plane and aligned at least approximately parallel to each other, said arms having first and second ends;

a base portion extending in the centre plane defined by the arms and having an inner and an outer surface, said base portion connecting the first and second arms at their first ends and forming an approximately U-shaped closure clip;

a first spike having a first end and a second end, extending from the inner surface of the base portion between the arms and parallel thereto, and connected with its first end to the base portion, wherein the length of the first spike is at least equal to a dimension of the cross-section of at least one of the arms; and, at least one second spike having first and second ends, which extends from the inner surface of the base portion between one of the arms and the first spike and parallel thereto and is connected with its first end to the base portion, wherein the length of the second spike is shorter than the length of the first spike, wherein the length of the first spike is sized so that the first spike extends with its second end into a gap between the arms when the closure clip is shifted to a closed configuration thereof, in which the closure clip is bent around the tubular or bag-shaped packaging to be closed and in which the arms lie approximately parallel to each other at least in sections, wherein the second end of the first arm faces towards the first end of the second arm and the second end of the second arm faces towards the first end of the first arm.

2. The closure clip according to claim 1, further comprising:

a third spike having first and second ends, which extends from the inner surface of the base portion between the other one of the arms and the first spike and parallel thereto and is connected with its first end to the base portion, wherein the length of the third spike is shorter than the length of the first spike.

3. The closure clip according to claim 1, where the length of the first spike is a multiple of a dimension of the cross-section of at least one of the arms.

4. The closure clip according to claim 1, where the cross-section of the first spike tapers towards its second end.

5. The closure clip according to claim 1, where the second and third spikes are arranged at a distance from and parallel to the centre plane defined by the arms.

6. The closure clip according to claim 5, where the second and third spikes are arranged on different sides of the plane defined by the arms.

7. The closure clip according to claim 6, where the second and/or third spike is arranged on the same side of the plane defined by the arms.

8. The closure clip according to claim 1, where the cross-section of the second and/or third spike tapers towards the second end.

9. The closure clip according to claim 1, where the first spike and/or the second and third spikes end in a sharp point at their second ends.

10. The closure clip according to claim 1, where a cam is arranged on the outer surface of the base portion.

* * * * *